US009399276B2

(12) United States Patent
Sakata

(10) Patent No.: US 9,399,276 B2
(45) Date of Patent: Jul. 26, 2016

(54) POLISHING APPARATUS

(71) Applicant: Ebara Corporation, Tokyo (JP)

(72) Inventor: Keisuke Sakata, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 14/549,744

(22) Filed: Nov. 21, 2014

(65) Prior Publication Data

US 2015/0151400 A1 Jun. 4, 2015

(30) Foreign Application Priority Data

Nov. 28, 2013 (JP) ..... 2013-245970

(51) Int. Cl.
*B24B 37/00* (2012.01)
*B24B 37/013* (2012.01)

(52) U.S. Cl.
CPC ..... *B24B 37/013* (2013.01)

(58) Field of Classification Search
CPC ..... B24B 49/16; B24B 49/12; B24B 37/013; B24B 37/042
USPC ..... 451/5
See application file for complete search history.

(56) References Cited

U.S. PATENT DOCUMENTS 4,272,924 A * 6/1981 Masuko ..... B24B 37/08 367/96
5,099,614 A * 3/1992 Arai ..... G01B 17/02 451/262
5,626,714 A * 5/1997 Miyazaki ..... B24B 37/013 204/298.32
6,000,996 A * 12/1999 Fujiwara ..... B24B 37/013 216/85
6,609,952 B1 * 8/2003 Simon ..... B24B 49/12 451/287
6,785,010 B2 * 8/2004 Kimba ..... B08B 1/04 356/630
2002/0000902 A1 * 1/2002 Tamura ..... H01P 1/047 333/246
2003/0019653 A1 * 1/2003 Kuga ..... H01R 13/03 174/68.1
2003/0124957 A1 * 7/2003 Kobayashi ..... B24B 37/013 451/9
2003/0153245 A1 * 8/2003 Talieh ..... B24B 21/04 451/8
2003/0202351 A1 * 10/2003 Takai ..... H01S 5/141 362/259
2007/0082582 A1 * 4/2007 Gwo ..... B24B 37/013 451/6
2013/0307474 A1 * 11/2013 Shimura ..... H01M 10/46 320/108
2015/0327850 A1 * 11/2015 Kostrzewski ..... A61B 17/0469 606/144

FOREIGN PATENT DOCUMENTS

EP 1241058 A2 * 9/2002
JP 07-100786 4/1995
JP 08-222459 8/1996

* cited by examiner

*Primary Examiner* — George Nguyen
(74) *Attorney, Agent, or Firm* — Leydig, Voit & Mayer, Ltd.

(57) ABSTRACT

A polishing apparatus which can perform power supply, signal transmission, and communication in a non-contact type to respective equipments in a polishing head and/or a polishing table by providing a non-contact type transmission connector having no physical contact point on at least one of the polishing head and the polishing table is disclosed. The polishing apparatus includes a non-contact transmission connector provided on at least one of the polishing table and the polishing head and configured to transfer electric power or signals or to perform communication between a stationary unit and a rotating unit which face each other in a non-contact manner. The electric power or the signals are transmitted or communication is performed between equipment provided in at least one of the polishing table and the polishing head, and the outside of the polishing table or the polishing head through the non-contact transmission connector.

21 Claims, 7 Drawing Sheets

POLISHING APPARATUS

CROSS REFERENCE TO RELATED APPLICATION

This document claims priority to Japanese Patent Application Number 2013-245970 filed Nov. 28, 2013, the entire contents of which are hereby incorporated by reference.

BACKGROUND

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). In the chemical mechanical polishing, using a polishing apparatus, while a polishing liquid containing abrasive particles such as silica ($SiO_2$) or ceria ($CeO_2$) therein is supplied onto a polishing pad, a substrate such as a semiconductor wafer is brought into sliding contact with the polishing surface and is polished.

The polishing apparatus for performing the above CMP process includes a polishing table having a polishing pad serving as a polishing surface, and a polishing head for holding a substrate such as a semiconductor wafer. By using such a polishing apparatus, the substrate is held and pressed against the polishing pad under a predetermined pressure by the polishing head to polish an insulating film, a metal film or the like on the substrate.

As one of the important technologies required for the CMP process that is performed in planarization after formation of the insulating film or formation process for the metal interconnection, there is polishing end point detection. Because excessive polishing or insufficient polishing with respect to target polishing end point is directly linked to product defects, it is necessary to control a polishing amount strictly. From such circumstances, the end point detection monitor (EPM: End Point Monitor) which can monitor a change of film thickness with high accuracy during polishing has become an indispensable technology for the productivity improvement of CMP and the improvement of yield ratio of semiconductor products.

A sensor for the end point detection monitor comprises an eddy current sensor or an optical sensor, and is embedded in the polishing table to monitor a surface, being polished, of the substrate during polishing. Further, various sensors for monitoring the condition of the surface, being polished, of the substrate during polishing are embedded in the polishing table, besides the sensor for the end point detection monitor. Therefore, it is necessary to supply electric power from the outside of the polishing table to measuring instruments including various sensors provided in the polishing table.

Further, it is necessary to send and receive input and output signals and to perform communication between the measuring instruments in the polishing table and equipments outside the polishing table. Thus, the measuring instruments in the polishing table are connected respectively to external power wires, signal wires, communication wires, and the like through a contact-type rotary connector (slip ring or rotary connector) having physical contact points. In order to allow these power wires, signal wires, communication wires and the like to be a waterproof structure, a waterproof structural object which encloses the contact-type rotary connector in its entirety is required to be provided.

Further, in the CMP process, because the substrate such as a semiconductor wafer is pressed against the polishing pad under a predetermined polishing pressure and is brought in sliding contact with the polishing pad to polish a surface of the substrate, a temperature in the contact surface between the substrate and the polishing pad, i.e., a polishing temperature increases. Since the polishing pad comprises a resin material such as foamed polyurethane, the polishing temperature changes rigidity of the polishing pad to exert an effect on planarization characteristics of the substrate. Further, since the chemical mechanical polishing (CMP) is a method for polishing the substrate by utilizing a chemical reaction between the polishing liquid (polishing slurry) and the surface, being polished, of the substrate, the polishing temperature has an effect on the chemical characteristics of the polishing slurry.

Therefore, a temperature sensor is provided in the polishing head for holding the substrate, and the temperature of the substrate or the temperature of the membrane for holding the substrate is measured during polishing. Further, various sensors for monitoring the state of the substrate or the polishing condition of the substrate during polishing are provided in the polishing head, besides the temperature sensor. Thus, measuring instruments including various sensors provided in the polishing head are connected respectively to external power wires, signal wires, communication wires, and the like through a contact-type rotary connector (slip ring or rotary connector) in the same manner as the polishing table.

However, the contact transmission structure having physical contact points such as a contact-type rotary connector has the following problems.

(1) It is necessary to replace parts of the contact transmission structure periodically due to wear or the like of the contact points.

(2) In the contact transmission structure having physical contact points, all the connectors are required to be replaced at the time of failure replacement.

(3) In the contact transmission structure having physical contact points, electric surge, noise or the like is generated from the contact points to cause an adverse effect on the power supply, signals, and communication circuits.

(4) In the contact transmission structure having physical contact points, the positional shift between the connector and the rotating shaft of the rotating body occurs to generate eccentricity of the connector.

(5) In the contact transmission structure having physical contact points, there are physical contact points to which electric voltage is applied, and thus waterproof protection becomes complex, resulting in a large-scale structure.

SUMMARY OF THE INVENTION

According to an embodiment, there is provided a polishing apparatus which can perform power supply, signal transmission, and communication in a non-contact type to respective equipments in a polishing head and/or a polishing table by providing a non-contact type transmission connector having no physical contact point on at least one of the polishing head and the polishing table in the polishing apparatus for polishing a substrate such as a semiconductor wafer by holding the substrate and pressing the substrate against a polishing surface on the polishing table with the polishing head.

Embodiments, which will be described below, relate to a polishing apparatus for polishing a substrate such as a semiconductor wafer by holding the substrate and pressing the substrate against a polishing surface on a polishing table with a polishing head.

In an embodiment, there is provided a polishing apparatus for polishing a substrate by pressing the substrate against a polishing surface on a polishing table with a polishing head while the polishing head holding the substrate is rotated and the polishing table is rotated, comprising: a non-contact transmission connector provided on at least one of the polishing table and the polishing head and configured to transfer electric power or signals or to perform communication between a stationary unit and a rotating unit which face each other in a non-contact manner; wherein the electric power or the signals are transmitted or communication is performed between equipment provided in at least one of the polishing table and the polishing head, and the outside of the polishing table or the polishing head through the non-contact transmission connector.

According to the above-described embodiment, the polishing apparatus can perform power supply, signal transmission, and communication in a non-contact type to respective equipments in a polishing head and/or a polishing table by providing a non-contact type transmission connector having no physical contact point on at least one of the polishing head and the polishing table. Therefore, dust is prevented from being generated between the stationary unit and the rotating unit to make cleaning unnecessary, and there is no mechanical wear to make periodic replacement of parts unnecessary, resulting in maintenance-free system.

In an embodiment, the equipment provided in the polishing table comprises a measuring instrument including a sensor configured to monitor a condition of a surface, being polished, of the substrate during polishing.

Sensors for monitoring a condition of the surface, being polished, of the substrate during polishing include a sensor for end point detection monitor comprising an eddy current sensor or an optical sensor. Further, various sensors for monitoring the condition of the surface, being polished, of the substrate during polishing are included, besides the sensor for the end point detection monitor.

In an embodiment, the equipment provided in the polishing head comprises a measuring instrument including a sensor configured to monitor a condition of the substrate during polishing.

Sensors for monitoring the condition of the substrate during polishing include a sensor for measuring the temperature of the substrate or the temperature of the membrane for holding the substrate during polishing. Further, various sensors for monitoring the state of the substrate or the polishing condition of the substrate during polishing are included, besides the temperature sensor.

In an embodiment, the non-contact transmission connector comprises at least one pot core, to which winding is applied, provided in the stationary unit and at least one pot core, to which winding is applied, provided in the rotating unit; the at least one pot core of the stationary unit and the at least one pot core of the rotating unit being configured to face each other.

In an embodiment, the non-contact transmission connector comprises a light emitting unit provided in one of the stationary unit and the rotating unit and a light receiving unit provided in the other of the stationary unit and the rotating unit; the light emitting unit and the light receiving unit being configured to face each other.

In an embodiment, the light emitting unit and the light receiving unit are disposed at the centers of the stationary unit and the rotating unit.

According to the above-described embodiment, since the light emitting unit and the light receiving unit are disposed at the centers of the stationary unit and the rotating unit, alignment of optical axes during rotation can be ensured.

In an embodiment, a plurality of objects configured to reflect light and refract light are provided between the light emitting unit and the light receiving unit, and the light emitted from the light emitting unit is directed to the light receiving unit through the objects configured to reflect light and refract light.

According to the above-described embodiment, by providing a plurality of objects configured to reflect light and refract light, an optical path from the light emitting unit to the light receiving unit can be freely established.

In an embodiment, the stationary unit and the rotating unit of the non-contact transmission connector have surfaces which face each other and are coated with a waterproof material.

According to the above-described embodiment, the surfaces of the stationary unit and the rotating unit which face each other are coated with a material (metal, resin or the like) which does not attenuate (absorb) electric field and magnetic field or is less likely to attenuate (absorb) electric field and magnetic field, and is capable of ensuring waterproof property, and thus the non-contact transmission connector can easily become a waterproof structure.

In an embodiment, a rotary joint is provided adjacent to the rotating unit of the non-contact transmission connector, and a fluid is supplied from the outside of the polishing table or the polishing head into the polishing table or the polishing head through the rotary joint.

In an embodiment, each of the light emitting unit and the light receiving unit comprises a light emitting and receiving unit which is capable of performing unidirectional communication and two-way communication.

In an embodiment, a controller configured to transfer electric power or signals or to perform communication with equipment provided in the rotating unit through the non-contact transmission connector is provided.

According to the above-described embodiments, the polishing apparatus can perform power supply, signal transmission, and communication in a non-contact type to respective equipments in the polishing head and/or the polishing table by providing a non-contact transmission connector having no physical contact point on at least one of the polishing head and the polishing table. Therefore, the following specific effects can be obtained.

(1) There is no mechanical wear to make periodic replacement of parts unnecessary, resulting in maintenance-free system.

(2) Since there is no physical contact point, it is only necessary to replace one side unit at the time of failure replacement, and thus maintenance time can be shortened.

(3) Because of the non-contact type, there is no generation factor of electric surge, noise or the like generated in the contact surface of the rotating part, and thus electric power, signals, and communication can be stably transmitted.

(4) When the rotating unit is fixed to a rotating body, even if a rotating axis of the rotating body and a rotating axis of the rotating unit are deviated away from each other, there is no physical contact surface, and a space exists between the rotating unit and the stationary unit. Therefore, vibrations caused by the inertia force are not transmitted, and interference caused by the inertia force at the rotating side does not occur.

(5) The surfaces of the stationary unit and the rotating unit which face each other are coated with a material (metal, resin or the like) which does not attenuate (absorb) electric field and magnetic field or is less likely to attenuate (absorb) electric field and magnetic field, and is capable of ensuring waterproof property, and thus the non-contact transmission connector can easily become a waterproof structure.

DESCRIPTION OF EMBODIMENTS

Figure 1:
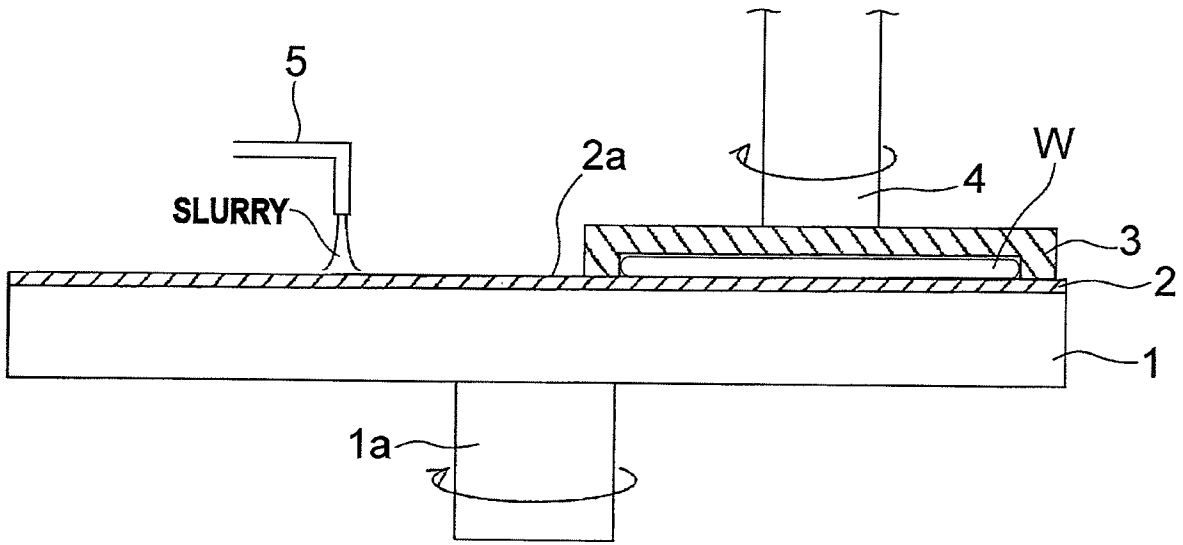
FIG. 1 is a schematic front view showing main part of a polishing apparatus according to an embodiment.

Embodiments of a polishing apparatus will be described below with reference to FIGS. 1 through 7. Like or corresponding structural elements are denoted by like or corresponding reference numerals in FIGS. 1 through 7 and will not be described below in duplication.

FIG. 1 is a schematic front view showing main part of a polishing apparatus according to an embodiment. As shown in FIG. 1, the polishing apparatus comprises a polishing table 1 for supporting a polishing pad 2, a polishing head 3 for holding a substrate W such as a semiconductor wafer as an object to be polished and pressing the substrate W against the polishing pad 2 on the polishing table 1, and a polishing liquid supply nozzle 5 for supplying a polishing liquid (slurry) onto the polishing pad 2.

The polishing table 1 is coupled via a table shaft 1*a* to a polishing table rotating motor (not shown) disposed below the polishing table 1. Thus, the polishing table 1 is rotatable about the table shaft 1*a*. The polishing pad 2 is attached to an upper surface of the polishing table 1. A surface of the polishing pad 2 constitutes a polishing surface 2*a* for polishing the substrate W. The polishing pad 2 comprising SUBA 800, IC1000, IC1000/SUBA400 (two-layer cloth) or the like manufactured by the Dow Chemical Company is used. The SUBA 800 is non-woven fabrics bonded by urethane resin. The IC1000 comprises a pad composed of hard polyurethane foam and having a large number of fine holes (pores) formed in its surface, and is also called a perforated pad.

The polishing head 3 is configured to hold the substrate W on its lower surface under vacuum attraction. A membrane (not shown) for pressing the substrate W by a pressurized fluid such as compressed air is provided in the polishing head 3. The polishing head 3 is coupled via a polishing head shaft 4 to a polishing head motor (not shown). Thus, the polishing head 3 is rotatable about the polishing head shaft 4. The polishing head 3 and the polishing table 1 are rotated in the same direction as shown by arrows, and in this state, the polishing head 3 presses the substrate against the polishing pad 2. The polishing liquid is supplied from the polishing liquid supply nozzle 5 onto the polishing pad 2, and the substrate is brought in sliding contact with the polishing pad 2 in the presence of the polishing liquid and is polished.

Next, a configuration of main part of the polishing table 1 and the polishing head 3 will be described with reference to FIGS. 2 and 3.

Figure 2B:
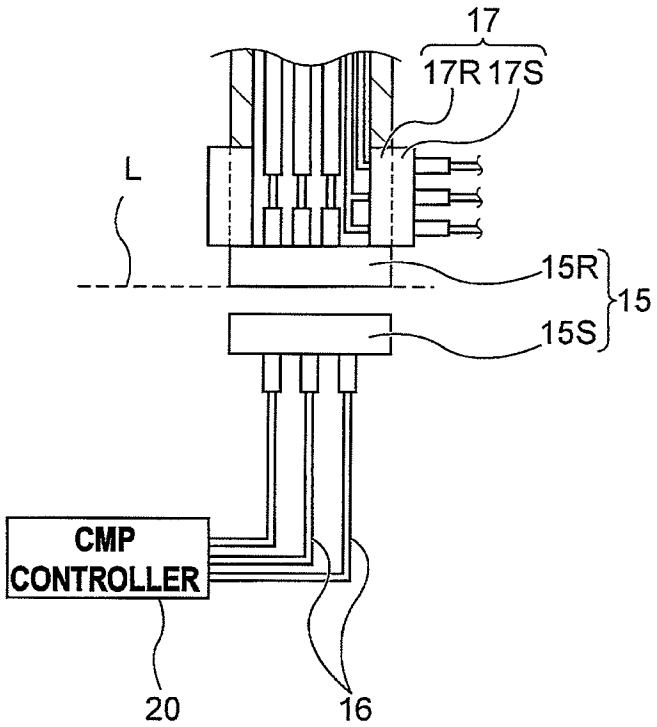
FIG. 2B is a partially enlarged view showing the state in which a stationary unit of a non-contact transmission connector in FIG. 2A is connected to a CMP controller by conducting wires.
Figure 2A:
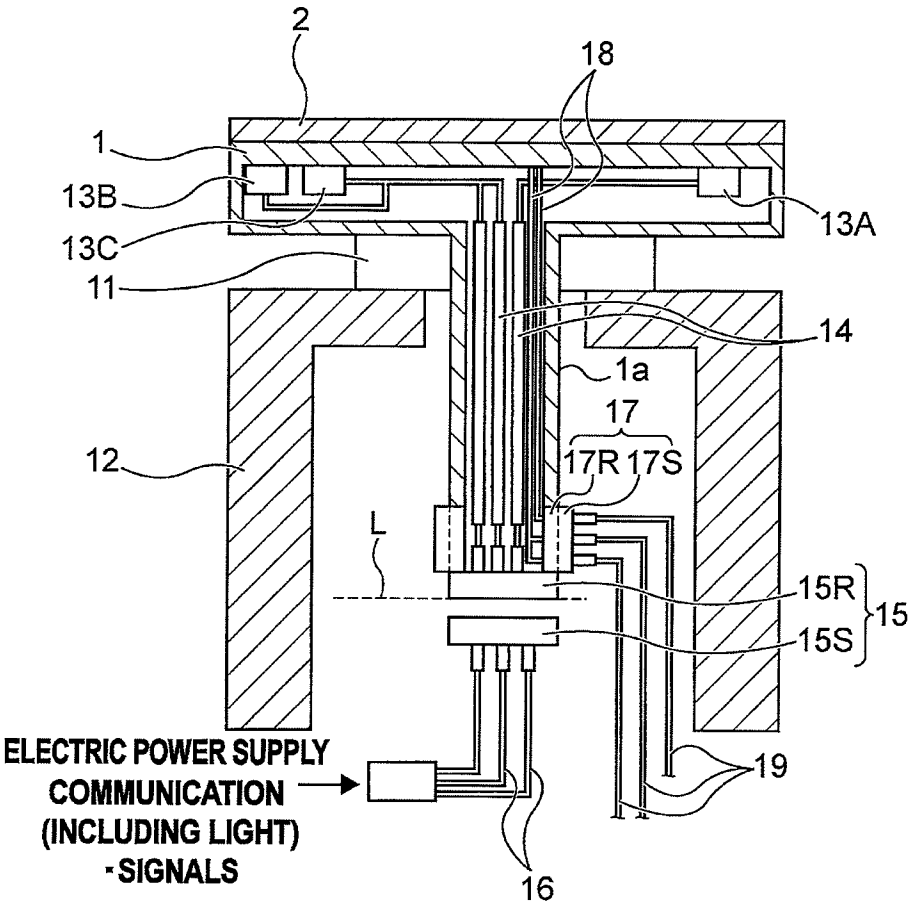
FIG. 2A is a schematic cross-sectional view showing main part of a polishing table.

FIG. 2A is a schematic cross-sectional view showing main part of the polishing table 1. As shown FIG. 2A, the polishing table 1 for supporting the polishing pad 2 is connected to a hollow table shaft 1*a*. A polishing table motor 11 is provided so as to surround the table shaft 1*a*. The polishing table motor 11 is supported by a motor base 12. Equipments 13A, 13B and 13C such as sensors are provided in the polishing table 1. Equipments such as sensors include an eddy current sensor and an optical sensor for end point detection monitor, and further include various sensors such as a temperature sensor for monitoring a condition of a surface, being polished, of the substrate during polishing, besides the sensors for the end point detection monitor. The respective equipments 13A, 13B and 13C are connected to external power supply, signal source and communication sender (including a light source and the like) through a non-contact transmission connector 15 having no physical contact point. Specifically, the respective equipments 13A, 13B and 13C are connected to a rotating unit 15R of the non-contact transmission connector 15 through conducting wires 14. The respective conductive wires 14 pass through the interior of the hollow table shaft 1*a* from the interior of the polishing table 1 and extend to the rotating unit 15R of the non-contact transmission connector 15. Further, conducting wires 16 are connected to a stationary unit 15S of the non-contact transmission connector 15, and the stationary unit 15S is connected to power supply, signal source and communication sender (including a light source and the like) by the conducting wires 16.

FIG. 2B is a partially enlarged view showing the state in which the stationary unit 15S of the non-contact transmission connector 15 in FIG. 2A is connected to a CMP controller 20 by the conducting wires 16. Further, the ends of the connecting wires 16 of the stationary unit 15 may be connected to power supply, signal source and communication sender (including a light source and the like) and the CMP controller.

As an example in which signals are transmitted, there is a case where signals obtained by the sensor for end point detection monitor during polishing are transmitted. In this case, signals obtained by the sensor for end point detection monitor provided in the rotating side are transmitted through the non-contact transmission connector 15 to the CMP controller 20 provided in the stationary side, and are subjected to data processing in the CMP controller 20 to monitor the condition of the surface being polished.

As an example in which communication is performed, there is a case where plural data measured by the respective equipments 13A, 13B and 13C are transmitted at one time or a case where the respective equipments 13A, 13B 13C are equipments for performing process processing and operation command data are sent from the controller provided at the stationary side to the respective equipments 13A, 13B and 13C. The respective equipments for performing the process processing include the polishing table motor, the polishing head motor, the light source of the optical sensor, and the like. In this manner, when large quantities of data are transmitted, large quantities of data communication can be performed in a short period of time by packet data transmission in which large quantities of data are split into packets, and are sent and received.

In FIG. 2A, inside the motor base 12, the rotating side is located above a line L shown by a dashed line and the stationary side is located below the line L. A rotary joint 17 is provided above the rotating unit 15R of the non-contact transmission connector 15. The rotary joint 17 comprises an inner rotating cylinder 17R and an outer stationary cylinder 17S. A plurality of pipes 18 extending to the interior of the polishing table 1 are connected to the rotating cylinder 17R, and a plurality of pipes 19 extending to a liquid source such as a pure water source are connected to the stationary cylinder 17S. The plural pipes 18, 19 include a cooling water pipe for cooling the polishing table 1, a pure water pipe for supplying pure water to the optical sensor provided in the polishing table 1, and the like. Therefore, the cooling water and the pure water are supplied from the outside to the interior of the polishing table 1 through the pipe 19, the rotary joint 17 and the pipe 18, and are used in the polishing table 1, and are then discharged to the outside.

Figure 6:
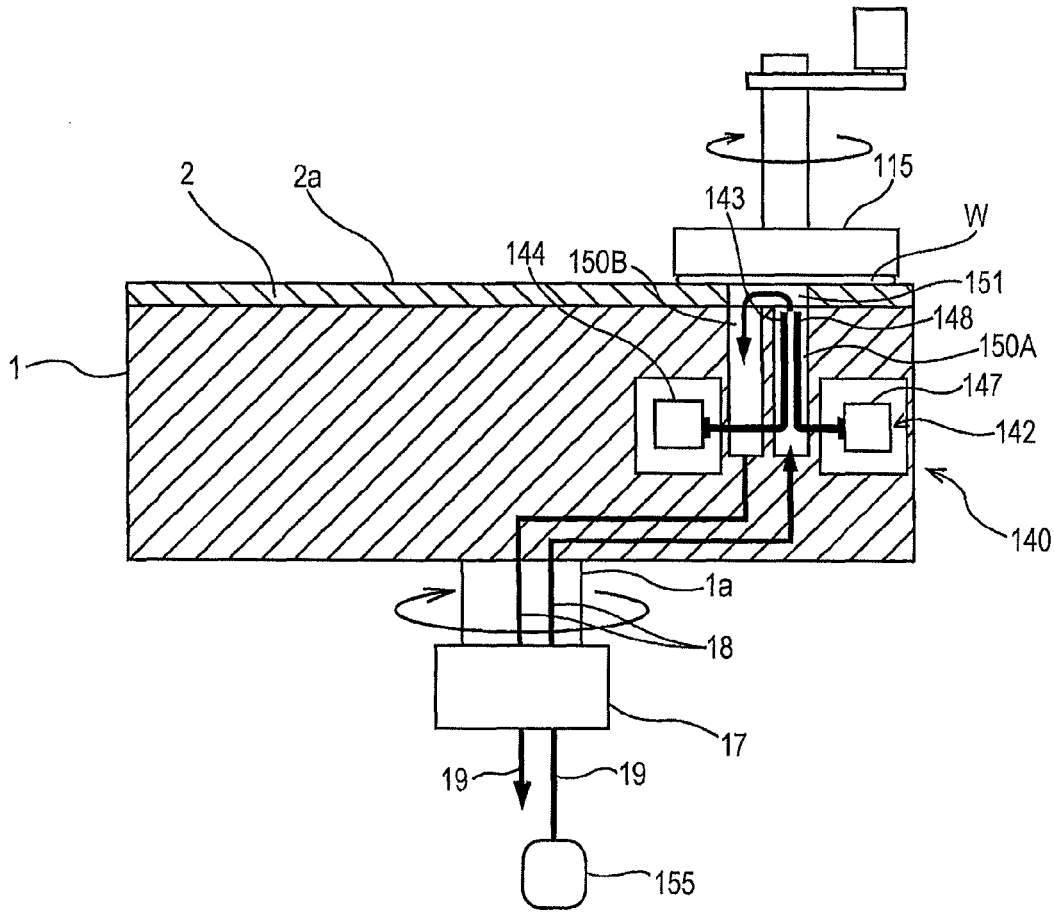
FIG. 6 is a schematic cross-sectional view showing an optical sensor provided in the polishing table.

Next, the optical sensor provided in the polishing table and the pipes for supplying the pure water to the optical sensor in the polishing apparatus of the embodiment are shown in FIG. 6. In FIG. 6, the non-contact transmission connector 15, the conducting wires connected to the non-contact transmission connector 15, and the like are omitted and are not shown. As shown in FIG. 6, an optical sensor 140 is embedded in the polishing table 1 and is rotated together with the polishing table 1. The optical sensor 140 applies light to the surface of the substrate W and receives reflected light from the substrate W, and then measures the intensity of the reflected light in each wavelength.

The optical sensor 140 includes a light emitting unit 142 for emitting light to the surface, being polished, of the substrate W, an optical fiber 143 serving as a light receiving unit for receiving the reflected light from the substrate W, and a spectrometer 144 configured to resolve the reflected light from the substrate W according to the wavelength and measure the intensity of the reflected light over a predetermined wavelength range.

The polishing table 1 has a first hole 150A and a second hole 150B having upper open ends lying in the upper surface of the polishing table 1. Further, the polishing pad 2 has a through-hole 151 at a position corresponding to the holes 150A and 150B. The holes 150A and 150B are in fluid communication with the through-hole 151, which has an upper open end lying in the polishing surface 2*a*. The first hole 150A is coupled to a liquid supply source 155 via a pipe 18 serving as a liquid supply passage, a rotary joint 17 and a pipe 19. The second hole 150B is coupled to the pipe 18 serving as a liquid discharge passage, the rotary joint 17 and the pipe 19.

The light emitting unit 142 includes a light source 147 for emitting multiwavelength light and an optical fiber 148 coupled to the light source 147. The optical fiber 148 is an optical transmission element for directing the light, emitted by the light source 147, to the surface of the substrate W. Tip ends of the optical fiber 148 and the optical fiber 143 lie in the first hole 150A and are located near the surface, to be polished, of the substrate W. The tip ends of the optical fiber 148 and the optical fiber 143 are arranged so as to face the center of the wafer W held by the top ring 115, so that multiple zones including the center of the substrate W are irradiated with the light each time the polishing table 1 makes one revolution.

During polishing of the substrate W, the liquid supply source 155 supplies water (preferably pure water) as a transparent liquid into the first hole 150A through the pipe 19 and the pipe 18. The water fills a space formed between the lower surface of the substrate W and the tip ends of the optical fibers 148 and 143. The water further flows into the second hole 150B and is discharged therefrom through the pipe 18 and the pipe 19. The polishing liquid is discharged together with the water and thus a path of light is secured. The pipe 19 serving as the liquid supply passage is provided with a valve (not shown) configured to operate in conjunction with the rotation of the polishing table 1. The valve operates so as to stop the flow of the water or reduce the flow rate of the water when the substrate W is not located over the through-hole 151.

The optical fiber 148 and the optical fiber 143 are arranged in parallel with each other. The tip ends of the optical fiber 148 and the optical fiber 143 are substantially perpendicular to the surface of the substrate W, so that the optical fiber 148 directs the light to the surface of the substrate W substantially perpendicularly.

During polishing of the substrate W, the light emitting unit 142 emits the light to the wafer W, and the optical fiber (light receiving unit) 143 receives the light reflected from the substrate W. The spectrometer 144 measures the intensity of the reflected light at each of the wavelengths over the predetermined wavelength range and sends the obtained light intensity data to a processing unit (not shown). The processing unit produces a spectral waveform showing the light intensity at each of the wavelengths from the light intensity data, and further produces the polishing index value representing the polishing progress of the substrate W from the spectral waveform.

Figure 3B:
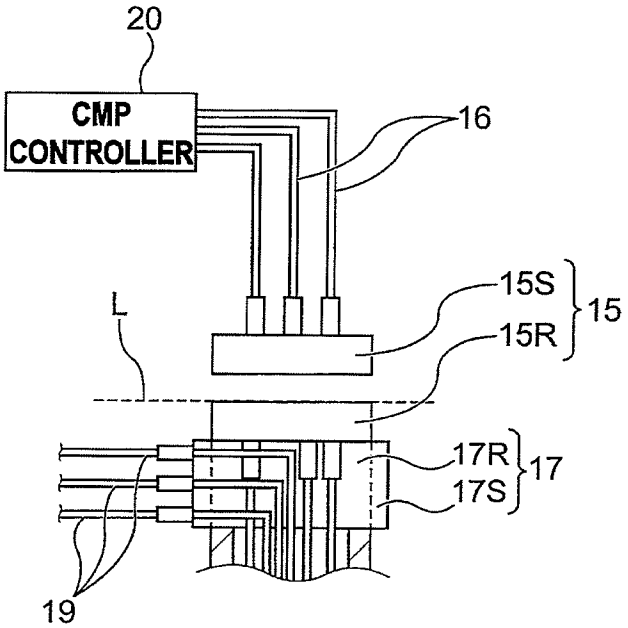
FIG. 3B is a partially enlarged view showing the state in which a stationary unit of a non-contact transmission connector in FIG. 3A is connected to the CMP controller by conducting wires.
Figure 3A:
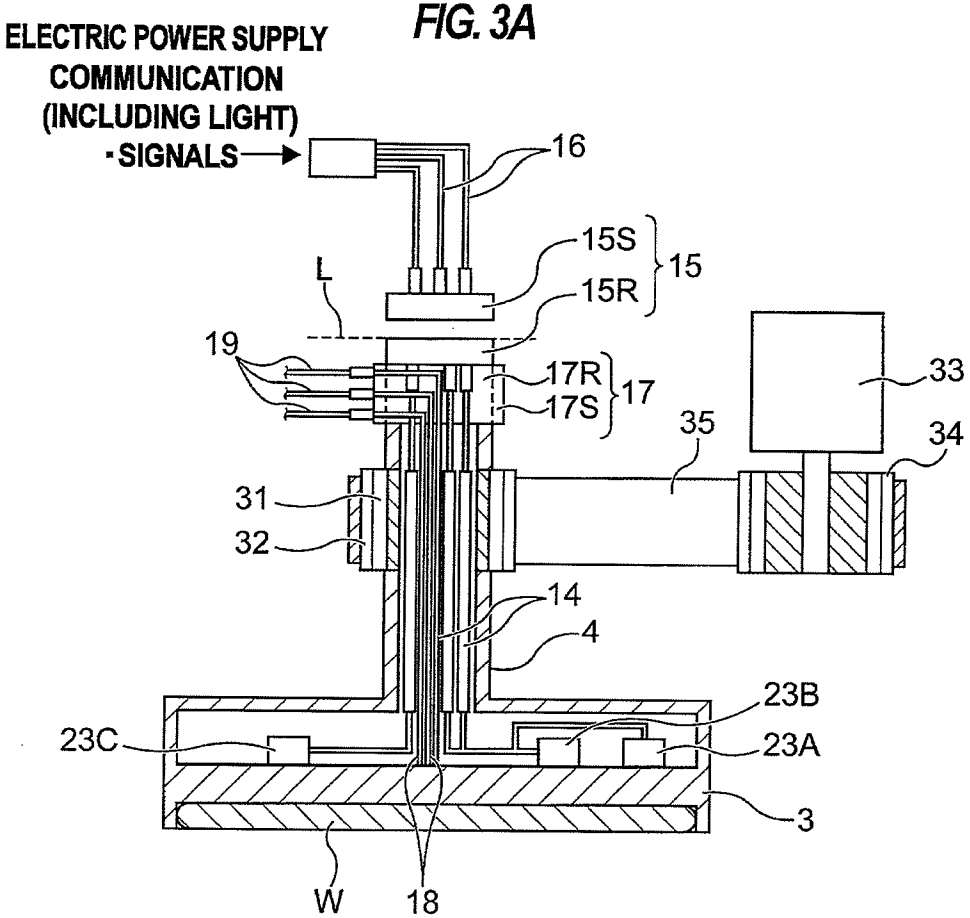
FIG. 3A is a schematic cross-sectional view showing main part of a polishing head.

FIG. 3A is a schematic cross-sectional view showing main part of the polishing head 3. As shown in FIG. 3A, the polishing head 3 for holding the substrate W is connected to a hollow polishing head shaft 4. The polishing head shaft 4 is coupled to a rotating cylinder 31 through a key (not shown). The rotating cylinder 31 has a timing gear 32 at its outer circumferential portion. Further, a timing gear 34 is fixed to the polishing head motor 33, and a timing belt 35 is wound around the timing gear 34 and the timing gear 32. Therefore, when the polishing head motor 33 is driven, the rotating cylinder 31 and the polishing head shaft 4 are rotated in unison with each other through the timing gear 34, the timing belt 35 and the timing gear 32, thus rotating the polishing head 3. The polishing head 3 is coupled to a vertical movement mechanism (not shown), and thus the polishing head 3 and the polishing head shaft 4 are configured to be lifted and lowered.

As shown in FIGS. 3A, 23A, 23B and 23C such as sensors are provided in the polishing head 3. Equipments such as sensors include a temperature sensor, and further include various sensors for monitoring the state of the substrate or the polishing condition during polishing, besides the temperature sensor. The respective equipments 23A, 23B and 23C are connected to external power supply, signal source, communication sender (including a light source and the like) via a non-contact transmission connector 15 having no physical contact point. Specifically, the respective equipments 23A, 23B and 23C are connected to a rotating unit 15R of the non-contact transmission connector 15 through conducting wires 14. The respective conductive wires 14 pass through the interior of the hollow polishing head shaft 4 from the interior of the polishing head 3 and extend to the rotating unit 15R of the non-contact transmission connector 15. Further, conducting wires 16 are connected to a stationary unit 15S of the non-contact transmission connector 15, and the stationary unit 15S is connected to power supply, signal source and communication sender (including a light source and the like) by the conducting wires 16. Further, the conducting wires 16 may be connected to the controller. FIG. 3B is a partially enlarged view showing the state in which the stationary unit 15S of the non-contact transmission connector 15 in FIG. 3A is connected to the CMP controller 20 by the conducting wires 16. Further, the ends of the connecting wires 16 of the stationary unit 15S may be connected to power supply, signal source and communication sender (including a light source and the like) and the CMP controller.

In FIG. 3A, the rotating side is located below a line L shown by a dashed line and the stationary side is located above the line L. A rotary joint 17 is provided below the rotating unit 15R of the non-contact transmission connector 15. The rotary joint 17 comprises an inner rotating cylinder 17R and an outer stationary cylinder 17S. A plurality of pipes 18 extending to the interior of the polishing head 3 are connected to the rotating cylinder 17R, and a plurality of pipes 19 extending to a fluid source such as a compressed air source are connected to the stationary cylinder 17S. The plural pipes 18,19 include pipes for supplying a pressurized fluid such as compressed air or vacuum to the polishing head 3. Therefore, the pressurized fluid or vacuum is supplied from the outside to the interior of the polishing head 3 through the pipe 19, the rotary joint 17 and the pipe 18.

Figure 7:
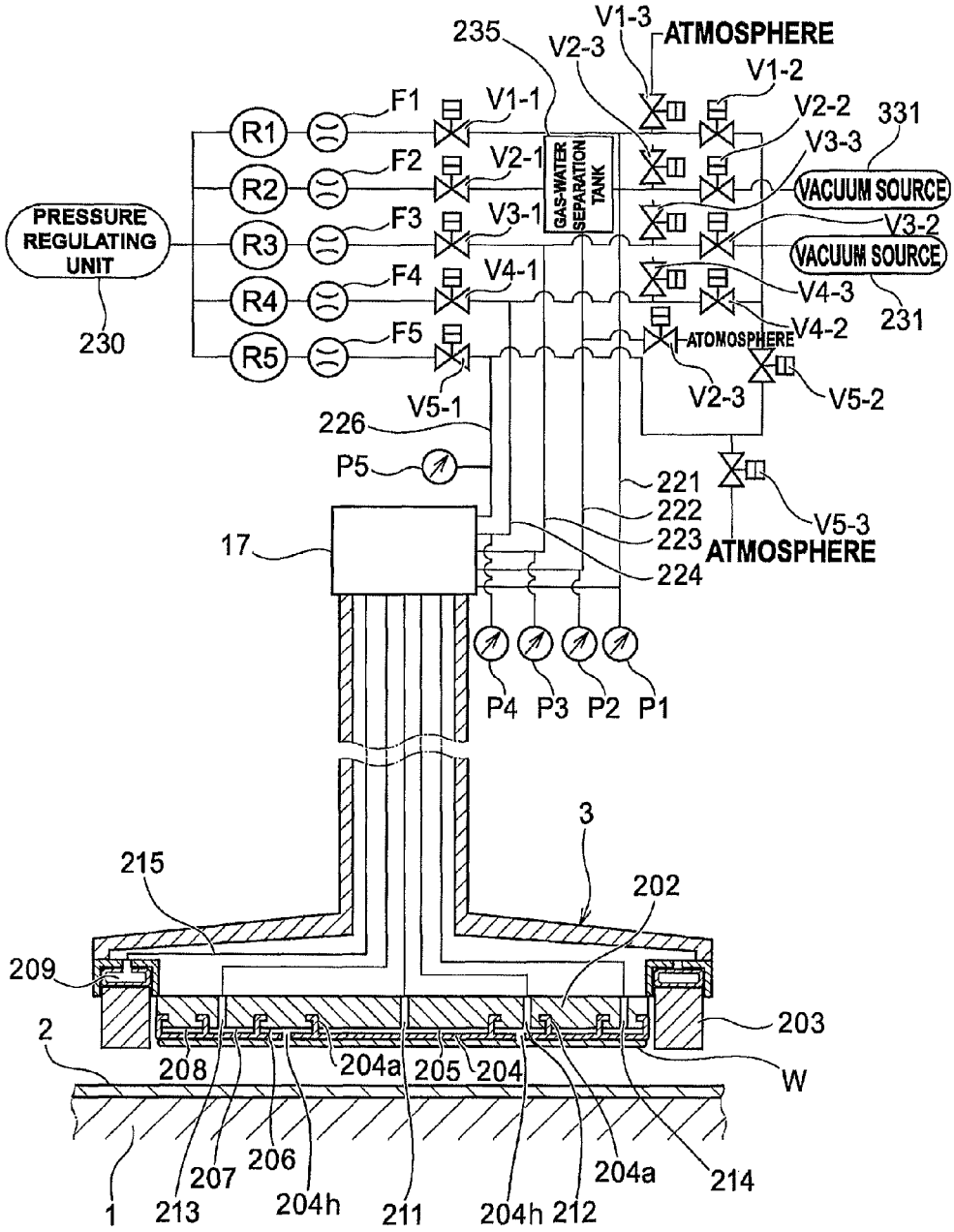
FIG. 7 is a schematic cross-sectional view showing main structural elements constituting the polishing head.

The polishing head and the flow passages (pipes) for supplying compressed air and vacuum to the polishing head will be described below. FIG. 7 is a schematic cross-sectional view showing main structural elements constituting the polishing head 3. In FIG. 7, the non-contact transmission connector 15, the conducting wires connected to the non-contact transmission connector 15, and the like are omitted and are not shown.

As shown in FIG. 7, the polishing head (top ring) 3 basically comprises a top ring body (which is also referred to as a carrier) 202 for pressing the wafer W against the polishing surface, and a retaining ring 203 for directly pressing the polishing surface. The retaining ring 203 is attached to a peripheral portion of the top ring body 202. An elastic membrane (membrane) 204, which is brought into contact with a rear face of the substrate, is attached to a lower surface of the top ring body 202.

The elastic membrane (membrane) 204 has a plurality of concentric partition walls 204*a*, which form a central chamber 205; a ripple chamber 206; an outer chamber 207; and an edge chamber 208 between the upper surface of the elastic membrane 204 and the lower surface of the top ring body 202. The elastic membrane (membrane) 204 has a plurality of holes 204*h* which pass through the elastic membrane in a thickness direction of the elastic membrane in the ripple area (ripple chamber 206). A flow passage 211 communicating with the central chamber 205, a flow passage 212 communicating with the ripple chamber 206, a flow passage 213 communicating with the outer chamber 207, and a flow passage 214 communicating with the edge chamber 208 are formed in the polishing head 3. The flow passage 211, the flow passage 213, and the flow passage 214 are connected via the rotary joint 17 to flow passages 221, 223, and 224, respectively. These flow passages 221, 223, and 224 are coupled to a pressure regulating unit 230 via respective valves V1-1, V3-1, and V4-1 and respective pressure regulators R1, R3, and R4. The flow passages 221, 223, and 224 are coupled to a vacuum source 231 through valves V1-2, V3-2, and V4-2 respectively, and further communicate with the atmosphere through valves V1-3, V3-3, and V4-3 respectively.

On the other hand, the flow passage 212 is coupled to the flow passage 222 via the rotary joint 17. The flow passage 222 is coupled to the pressure regulating unit 230 via a gas-water separation tank 235, a valve V2-1, and a pressure regulator R2. Further, the flow passage 222 is coupled to a vacuum source 331 via the gas-water separation tank 235 and a valve V2-2, and further communicates with the atmosphere via a valve V2-3.

Further, a retaining ring pressure chamber 209, which is formed by an elastic membrane, is provided immediately above the retaining ring 203. This retaining ring pressure chamber 209 is coupled to a flow passage 226 via a flow passage 215 formed in the top ring body 202 and the rotary joint 17. The flow passage 226 is coupled to the pressure regulating unit 230 via a valve V5-1 and a pressure regulator R5. Further, the flow passage 226 is coupled to the vacuum source 231 via a valve V5-2, and communicates with the atmosphere through a valve V5-3. The pressure regulators R1, R2, R3, R4, and R5 have a pressure regulating function to regulate pressures of the pressurized fluid supplied from the pressure regulating unit 230 to the central chamber 205, the ripple chamber 206, the outer chamber 207, the edge chamber 208, and the retaining ring pressure chamber 209, respectively. The respective pressure regulators and the respective valves are coupled to the controller (not shown), so that operations of these pressure regulators and these valves are controlled by the controller. Further, pressure sensors P1, P2, P3, P4, and P5 and flow rate sensors F1, F2, F3, F4, and F5 are provided in the flow passages 221, 222, 223, 224, and 226, respectively.

In the polishing head 3 configured as shown in FIG. 7, as described above, the pressures of the fluid supplied to the central chamber 205, the ripple chamber 206, the outer chamber 207, the edge chamber 208, and the retaining ring pressure chamber 209 can be independently controlled by the pressure regulating unit 230 and the pressure regulators R1, R2, R3, R4, and R5. With this structure, forces of pressing the substrate W against the polishing pad 2 can be adjusted at respective local areas of the substrate, and a force of pressing the polishing pad 2 by the retaining ring 203 can be adjusted. The flow passages 211, 212, 213, 214 and 215 correspond to the pipes 18 shown in FIG. 3, and the flow passages 221, 222, 223, 224 and 226 correspond to the pipes 19 shown in FIG. 3.

Detailed structure of the non-contact transmission connector 15 used in the polishing table 1 and the polishing head 3 according to the embodiment will be described below with reference to FIGS. 4 and 5.

Figure 4:
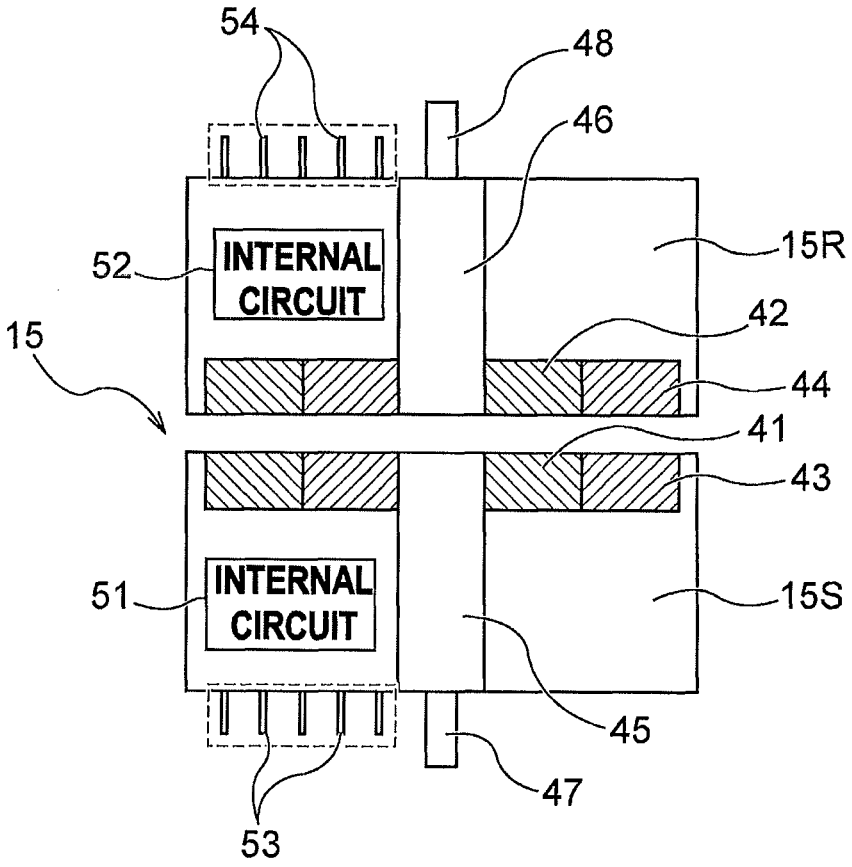
FIG. 4 is a schematic cross-sectional view showing a first aspect of the non-contact transmission connector.

FIG. 4 is a schematic cross-sectional view showing a first aspect of the non-contact transmission connector 15. As shown in FIG. 4, a power transmission pot core 41 comprising a pot-core-type primary side high-frequency magnetic material to which primary winding is applied is disposed in the stationary unit 15S of the non-contact transmission connector 15. A power transmission pot core 42 comprising a pot-core-type secondary side high-frequency magnetic material to which secondary winding is applied is disposed in the rotating unit 15R. The power transmission pot core 41 and the power transmission pot core 42 are coaxially disposed so as to face each other with a gap therebetween. Medium other than solid, for example, a gas such as air, vacuum, or a liquid, which does not attenuate (absorb) electric field and magnetic field or is less likely to attenuate (absorb) electric field and magnetic field exists in the gap between the power transmission pot core 41 and the power transmission pot core 42. The electric power transmission is performed by electromagnetic induction in which high-frequency current is applied to the primary winding of the pod core 41 at the stationary side and electric voltage is induced in the secondary winding of the pod core 42 at the rotating side.

Further, a signal transmission pot core 43 is disposed in the stationary unit 15S of the non-contact transmission connector 15, and a signal transmission pot core 44 is disposed in the rotating unit 15R. The signal transmission pot core 43 and the signal transmission pot core 44 are coaxially disposed so as to face each other with a gap therebetween. The signal transmission pot cores 43 and 44 comprise a pot core type magnetic material to which winding is applied as with the pod cores 41 and 42. The signal transmission is performed by electromagnetic induction in which high-frequency current on which information signals are superimposed is applied to the winding of the signal transmission pot core 43 or the signal transmission pot core 44 and information signal electric voltage is induced in the winding of the signal transmission pot core 44 or the signal transmission pot core 43.

As shown in FIG. 4, the stationary unit 15S and the rotating unit 15R have internal circuits 51, 52, respectively therein, and have connecting terminals 53, 54 for connecting the conducting wires, respectively.

As described above, the electric power transmission and the signal transmission are performed by non-contact transmission caused by electromagnetic induction action. In this case, as magnetic flux density (T (tesla)) between a pair of pot cores facing each other is higher, more stable transmission can be performed. In the case where the magnetic flux density cannot be heightened, as surface areas ($m^2$) of the pair of pot cores facing each other are larger, more stable transmission can be performed.

As shown in FIG. 4, light emitting and receiving units 45, 46 for communication are disposed respectively in the stationary unit 15S and the rotating unit 15R of the non-contact transmission connector 15. The light emitting and receiving units 45, 46 have a light emitting element and a light receiving element. The light emitting and receiving unit 45 for communication and the light emitting and receiving units 46 for communication are disposed at the centers of the stationary unit 15S and the rotating unit 15R, respectively, and are coaxially disposed so as to face each other with a narrow gap therebetween. In this manner, since the light emitting and receiving units 45, 46 for communication are disposed at the centers of the stationary unit 15S and the rotating unit 15R, alignment of optical axes during rotation can be ensured. Further, by making areas of the facing surfaces of the light emitting and receiving units 45, 46 larger, even if misalignment of the axes occurs, transmission of light can be facilitated. Optical fiber cables 47, 48 for communication are connected to the light emitting and receiving units 45, 46, respectively.

In the non-contact transmission connector 15 shown in FIG. 4, the lower unit serves as the stationary unit 15S and the upper unit serves as the rotating unit 15R. However, the lower unit may serve as the rotating unit 15R and the upper unit may serve as the stationary unit 15S.

Figure 5:
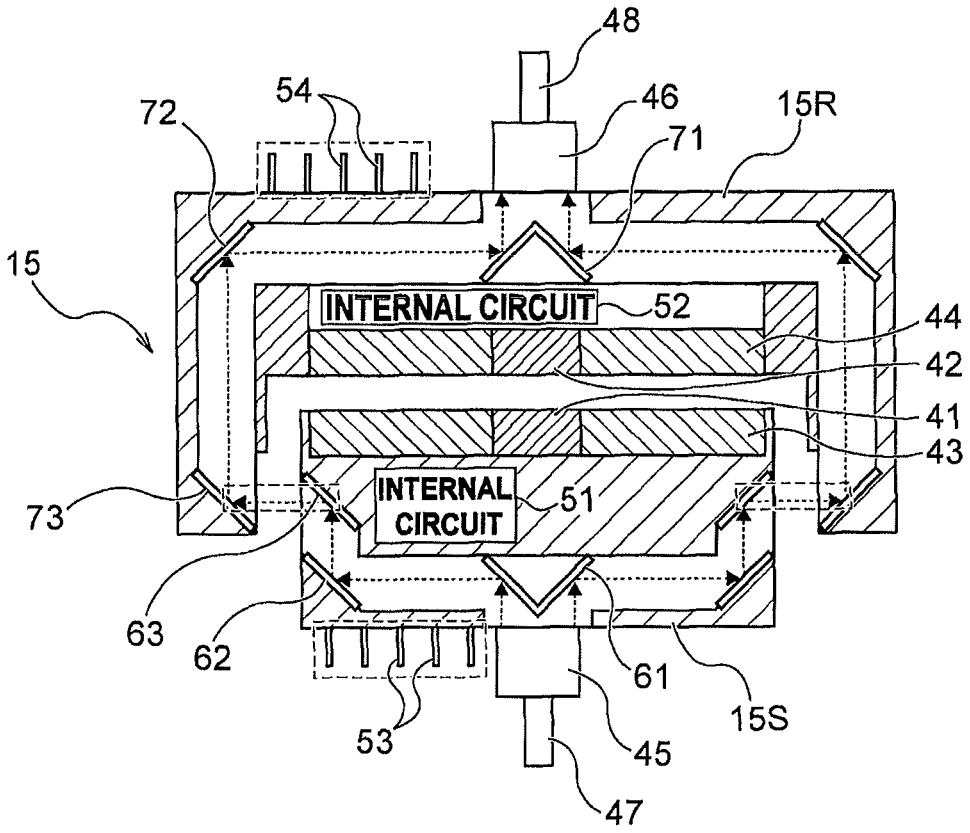
FIG. 5 is a schematic cross-sectional view showing a second aspect of the non-contact transmission connector.

FIG. 5 is a schematic cross-sectional view showing a second aspect of the non-contact transmission connector 15. In the non-contact transmission connector 15 shown in FIG. 5, the upper unit is formed into a cylindrical container shape having an open lower end and a closed upper end, and a column-shaped lower unit is housed in the cylindrical container-shaped upper unit. In the following description, the lower unit serves as the stationary unit 15S and the upper unit serves as the rotating unit 15R. However, the upper unit and the lower unit may be reversed. In this case, the cylindrical container-shaped unit should be disposed at the upper side.

As shown in FIG. 5, the stationary unit 15S is housed in the cylindrical container-shaped rotating unit 15R to prevent any foreign matter from entering the gap between the rotating unit 15R and the stationary unit 15S and to prevent any liquid from being collected in the gap between the rotating unit 15R and the stationary unit 15S. The power transmission pot core 41 is disposed in the stationary unit 15S, and the power transmission pot core 42 is disposed in the rotating unit 15R in the same manner as the example shown in FIG. 4. The power transmission pot core 41 and the power transmission pot core 42 are coaxially disposed so as to face each other with a gap therebetween. Further, the signal transmission pot core 43 is disposed in the stationary unit 15S, and the signal transmission pot core 44 is disposed in the rotating unit 15R. The signal transmission pot core 43 and the signal transmission pot core 44 are coaxially disposed so as to face each other with a gap therebetween. The stationary unit 15S and the rotating unit 15R have internal circuits 51, 52, respectively therein, and have connecting terminals 53, 54, respectively as with the non-contact transmission connector 15 shown in FIG. 4.

According to the present embodiment, the light emitting and receiving unit 45 and the light emitting and receiving unit 46 are disposed at the centers of the stationary unit 15S and the rotating unit 15R, but the light emitting and receiving units 45, 46 do not perform the transfer of light therebetween directly but perform the transfer of light therebetween by using a plurality of objects for reflecting light and refracting light and interposing these objects therebetween. The objects to reflect the light include a mirror, for example, and the objects to refract the light include a prism. In the present embodiment, the mirror is used. Specifically, in the stationary unit 15S, a first mirror 61 having a conical shape is disposed at a position facing the light emitting and receiving unit 45, and a second mirror 62 having a conical shape is disposed at the outer circumferential side of the first mirror 61 so as to surround the first mirror 61. Further, a third mirror 63 having a conical shape is disposed above the second mirror 62. On the other hand, in the rotating unit 15R, a first mirror 71 having a conical shape is disposed at a position facing the light emitting and receiving unit 46, and a second mirror 72 having a conical shape is disposed at the outer circumferential side of the first mirror 71 so as to surround the first mirror 71. Further, a third mirror 73 having a conical shape is disposed below the second mirror 72. The third mirror 73 of the rotating unit is disposed so as to surround the third mirror 63 of the stationary unit. The respective mirrors 61, 62, 63, 71, 72 and 73 have reflecting surfaces inclined at an angle of 45° so that a horizontal incident light is changed to a vertical reflected light or a vertical incident light is changed to a horizontal reflected light. Optic fiber cables 47, 48 for communication are connected to the light emitting and receiving unit 45 and the light emitting and receiving unit 46, respectively.

In the illustrated example, the light applied to the first mirror 61 from the light emitting and receiving unit 45 at the stationary unit 15S is reflected at the outer circumferential surface of the first mirror 61 and is applied to the second mirror 62, and then the light is reflected at the inner circumferential surface of the second mirror 62 and is applied to the third mirror 63. Then, the light is reflected at the outer circumferential surface of the third mirror 63 and is applied to the third mirror 73 of the rotating unit 15R. Then, the light applied to the third mirror 73 is reflected at the inner circumferential surface of the third mirror 73 and is applied to the second mirror 72, and then the light is reflected at the inner circumferential surface of the second mirror 72 and is applied to the first mirror 71. Then, the light is reflected at the outer circumferential surface of the first mirror 71 and is applied to the emitting and receiving unit 46 of the rotating unit 15R. The transmission sections of light in the stationary unit 15S and the rotating unit 15R are composed of a material which can transmit light as with the optical fiber. In this manner, optical communication from the stationary unit 15S to the rotating unit 15R can be performed. The optical communication from the rotating unit 15R to the stationary unit 15S can be performed by the optical path that is counter to the illustrated example. In this manner, optical two-way communication can be performed. However, the light emitting unit and the light receiving unit may be separated to perform unidirectional communication.

According to the non-contact transmission connector 15 shown in FIGS. 4 and 5, power supply, signal transmission, and communication by the non-contact type having no physical contact point can be performed. Therefore, dust is prevented from being generated between the stationary unit 15S and the rotating unit 15R to make cleaning unnecessary, and there is no mechanical wear to make periodic replacement of parts unnecessary, resulting in maintenance-free system. Further, the stationary unit 15S and the rotating unit 15R have no physical contact surface, and the respective units 15S, 15R are independent structural objects. Thus, in the case where ether one of the units is broken, it is only necessary to replace the broken unit only. Further, there is no generation factor of electric surge, noise or the like generated in the contact surface of the rotating part, and thus electric power, signals, and communication can be stably transmitted.

In the conventional contact-type connector, if the axis of the stationary unit and the axis of the rotating unit are not aligned with each other and there is angle deviation, an inertia force corresponding to the angle deviation θ is generated to generate mechanical vibrations. However, according to the non-contact transmission connector 15 shown in FIGS. 4 and 5, when the rotating unit 15R is fixed to a rotating body, even if a rotating axis of the rotating body and a rotating axis of the rotating unit 15R are deviated away from each other, there is no physical contact surface, and a space exists between the rotating unit 15R and the stationary unit 15S. Therefore, vibrations caused by the inertia force are not transmitted, and interference caused by the inertia force at the rotating side does not occur. Further, the surfaces of the stationary unit 15S and the rotating unit 15R which face each other are coated with a material (metal, resin or the like) which does not attenuate (absorb) electric field and magnetic field or is less likely to attenuate (absorb) electric field and magnetic field, and is capable of ensuring waterproof property, and thus the non-contact transmission connector 15 can easily become a waterproof structure. Other portions such as outer circumferential surfaces of the stationary unit 15S and the rotating unit 15R are coated with metal, resin or the like in the same manner, thereby providing a waterproof structure.

In the non-contact transmission connector 15 shown in FIGS. 4 and 5, the two sets of pot cores and a set of a light emitting unit and a light receiving unit are shown. However, three or more sets of pot cores may be used, and two or more sets of light emitting unit and light receiving unit may be used.

Although the preferred embodiments of the present invention have been described above, it should be understood that the present invention is not limited to the above embodiments, but various changes and modifications may be made to the embodiments without departing from the scope of the appended claims.

What is claimed is:

1. A polishing apparatus for polishing a substrate by pressing the substrate against a polishing surface on a polishing table with a polishing head while the polishing head holding the substrate is rotated and the polishing table is rotated, comprising:

a non-contact transmission connector provided on at least one of the polishing table and the polishing head and configured to transfer electric power or signals or to perform communication between a stationary unit and a rotating unit which face each other in a non-contact manner;

wherein the electric power or the signals are transmitted or communication is performed between equipment provided in at least one of the polishing table and the polishing head, and the outside of the polishing table or the polishing head through the non-contact transmission connector; and wherein the non-contact transmission connector comprises a light emitting unit provided in one of the stationary unit and the rotating unit and a light receiving unit provided in the other of the stationary unit and the rotating unit; the light emitting unit and the light receiving unit being configured to face each other.

2. The polishing apparatus according to claim 1, wherein the equipment provided in the polishing table comprises a measuring instrument including a sensor configured to monitor a condition of a surface, being polished, of the substrate during polishing.

3. The polishing apparatus according to claim 1, wherein the equipment provided in the polishing head comprises a measuring instrument including a sensor configured to monitor a condition of the substrate during polishing.

4. The polishing apparatus according to claim 1, wherein the non-contact transmission connector comprises at least one pot core, to which winding is applied, provided in the stationary unit and at least one pot core, to which winding is applied, provided in the rotating unit; the at least one pot core of the stationary unit and the at least one pot core of the rotating unit being configured to face each other.

5. The polishing apparatus according to claim 1, wherein the light emitting unit and the light receiving unit are disposed at the centers of the stationary unit and the rotating unit.

6. The polishing apparatus according to claim 1, wherein a plurality of objects configured to reflect light and refract light are provided between the light emitting unit and the light receiving unit, and the light emitted from the light emitting unit is directed to the light receiving unit through the objects configured to reflect light and refract light.

7. The polishing apparatus according to claim 1, wherein the stationary unit and the rotating unit of the non-contact transmission connector have surfaces which face each other and are coated with a waterproof material.

8. The polishing apparatus according to claim 1, wherein a rotary joint is provided adjacent to the rotating unit of the non-contact transmission connector, and a fluid is supplied from the outside of the polishing table or the polishing head into the polishing table or the polishing head through the rotary joint.

9. The polishing apparatus according to claim 1, wherein each of the light emitting unit and the light receiving unit comprises a light emitting and receiving unit which is capable of performing unidirectional communication and two-way communication.

10. The polishing apparatus according to claim 1, wherein a controller configured to transfer electric power or signals or to perform communication with equipment provided in the rotating unit through the non-contact transmission connector is provided.

11. A polishing apparatus for polishing a substrate by pressing the substrate against a polishing surface on a polishing table with a polishing head while the polishing head holding the substrate is rotated and the polishing table is rotated, comprising:

a non-contact transmission connector provided on at least one of the polishing table and the polishing head and configured to transfer electric power or signals or to perform communication between a stationary unit and a rotating unit which face each other in a non-contact manner;

wherein the electric power or the signals are transmitted or communication is performed between equipment provided in at least one of the polishing table and the polishing head, and the outside of the polishing table or the polishing head through the non-contact transmission connector; and wherein the equipment provided in the polishing head comprises a measuring instrument including a sensor configured to monitor a condition of the substrate during polishing.

12. The polishing apparatus according to claim 11, wherein the equipment provided in the polishing table comprises a measuring instrument including a sensor configured to monitor a condition of a surface, being polished, of the substrate during polishing.

13. The polishing apparatus according to claim 11, wherein the non-contact transmission connector comprises at least one pot core, to which winding is applied, provided in the stationary unit and at least one pot core, to which winding is applied, provided in the rotating unit; the at least one pot core of the stationary unit and the at least one pot core of the rotating unit being configured to face each other.

14. The polishing apparatus according to claim 11, wherein the stationary unit and the rotating unit of the non-contact transmission connector have surfaces which face each other and are coated with a waterproof material.

15. The polishing apparatus according to claim 11, wherein a rotary joint is provided adjacent to the rotating unit of the non-contact transmission connector, and a fluid is supplied from the outside of the polishing table or the polishing head into the polishing table or the polishing head through the rotary joint.

16. The polishing apparatus according to claim 11, wherein a controller configured to transfer electric power or signals or to perform communication with equipment provided in the rotating unit through the non-contact transmission connector is provided.

17. A polishing apparatus for polishing a substrate by pressing the substrate against a polishing surface on a polishing table with a polishing head while the polishing head holding the substrate is rotated and the polishing table is rotated, comprising:

a non-contact transmission connector provided on at least one of the polishing table and the polishing head and configured to transfer electric power or signals or to perform communication between a stationary unit and a rotating unit which face each other in a non-contact manner;

wherein the electric power or the signals are transmitted or communication is performed between equipment provided in at least one of the polishing table and the polishing head, and the outside of the polishing table or the polishing head through the non-contact transmission connector; and wherein a rotary joint is provided adjacent to the rotating unit of the non-contact transmission connector, and a fluid is supplied from the outside of the polishing table or the polishing head into the polishing table or the polishing head through the rotary joint.

18. The polishing apparatus according to claim 17, wherein the equipment provided in the polishing table comprises a measuring instrument including a sensor configured to monitor a condition of a surface, being polished, of the substrate during polishing.

19. The polishing apparatus according to claim 17, wherein the non-contact transmission connector comprises at least one pot core, to which winding is applied, provided in the stationary unit and at least one pot core, to which winding is applied, provided in the rotating unit; the at least one pot core of the stationary unit and the at least one pot core of the rotating unit being configured to face each other.

20. The polishing apparatus according to claim 17, wherein the stationary unit and the rotating unit of the non-contact transmission connector have surfaces Which face each other and are coated with a waterproof material.

21. The polishing apparatus according to claim 17, wherein a controller configured to transfer electric power or signals or to perform communication with equipment provided in the rotating unit through the non-contact transmission connector is provided.

* * * * *